US006821161B1

(12) United States Patent
Cao

(10) Patent No.: US 6,821,161 B1
(45) Date of Patent: Nov. 23, 2004

(54) ELECTRICAL CONNECTOR WITH PROTECTIVE SPACER

(75) Inventor: Xiang Cao, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/691,148

(22) Filed: Oct. 21, 2003

(30) Foreign Application Priority Data

May 23, 2003 (TW) ..... 92209548 U

(51) Int. Cl.[7] ..... H01R 13/502; H01R 13/514
(52) U.S. Cl. ..... 439/701; 439/79
(58) Field of Search ..... 439/701, 79, 567, 439/594, 599, 707

(56) References Cited

U.S. PATENT DOCUMENTS 5,713,746 A * 2/1998 Olson et al. ..... 439/79
6,093,060 A * 7/2000 Wiebking et al. ..... 439/676
6,179,629 B1 * 1/2001 Lai et al. ..... 439/79
6,210,218 B1 * 4/2001 Chang ..... 439/567
6,354,875 B1 * 3/2002 Wu ..... 439/607
6,508,676 B1 * 1/2003 Xu ..... 439/660
6,561,829 B2 * 5/2003 Maeda et al. ..... 439/247
2001/0023142 A1 * 9/2001 Miwa et al. ..... 439/79
2002/0192988 A1 * 12/2002 Droesbeke et al. ..... 439/79
2003/0109151 A1 * 6/2003 Xu ..... 439/79
2004/0029428 A1 * 2/2004 Wu ..... 439/357

* cited by examiner

*Primary Examiner*—Michael C. Zarroli
(74) *Attorney, Agent, or Firm*—Wei Te Chung

(57) ABSTRACT

An electrical connector (1) includes an insulative housing (10) defining a plurality of channels (102), a plurality of contacts (12) received in the housing and a spacer (14) engaged with the housing. The contacts are partially received in the housing and extend out of the housing via the corresponding channels. Each contact defines a tail portion (120), which is out of the housing and receives through the channel. The spacer comprises a base (140) defining a pair of fastening arms (142) and a pair of guiding blocks (1404). The base of the spacer defines a plurality of island platforms (1402) thereon, each island platform defining a passageway (1400) therethrough. The tail portion of the contact electrically connecting to the PCB via a corresponding passageway, which enhances the strength of the tail portion and prevents the contact from being bended or broken during the course of mounting the connector onto the PCB.

8 Claims, 4 Drawing Sheets

ELECTRICAL CONNECTOR WITH PROTECTIVE SPACER

BACKGROUND OF THE INVENTION

1. Field of the Invention

The present invention relates to an electrical connector mounted on a printed circuit board (PCB) for supplying power to a computer system.

2. Description of the Related Art

Referring to FIG. 4, a prior art electrical connector 2 electrically mounted on a PCB (not shown) for supplying power to a computer system (not shown) comprises an insulative housing 20 defining a plurality of channels 202 and a plurality of contacts 22 partially received in the housing 20. The contacts 20 are partially received in the housing 20 and extend out of the housing 20 via the corresponding channels 202. In order to electrically connecting to the PCB, each contact 22 defines a tail portion 220, which is out of the housing 20 and proximately perpendicular to the channels 202 for engaging with corresponding holes (not shown) of the PCB. Each tail portion 220 is long enough to ensure reliable connection between the contact 22 and the PCB. However, the length of the tail portion 220 of the contact 22 is too great that the tail portion 220 will be bended to an incorrect position not perpendicular to the channel 202 during the process of mounting the connector 2 onto the PCB by incorrect exterior force. The tail portion 220 of the contact 22 will be curved or even broken, and as a result, the contact 22 cannot engage with the PCB correctly.

Hence, a new electrical connector is desired to overcome the above-described disadvantages.

SUMMARY OF THE INVENTION

An object of the present invention is to provide an electrical connector which has a spacer for protecting contacts from being damaged during the course of mounting the connector onto a PCB.

In order to achieve the aforementioned object, an electrical connector in accordance with a preferred embodiment of the present invention comprises an insulative housing defining a plurality of channels, a plurality of contacts received in the housing and a spacer engaged with the housing. The contacts are partially received in the housing and extend out of the housing via the corresponding channels. Each contact defines a tail portion, which is out of the housing and receives through the channel. The spacer comprises a base defining a pair of fastening arms and a pair of guiding blocks. The base of the spacer defines a plurality of island platforms thereon, each island platform defining a passageway therethrough. The tail portion of the contact electrically connects to the PCB via a corresponding passageway, which enhances the intension of the tail portion and prevents the contact from being damaged during the course of mounting the connector onto the PCB.

Other objects, advantages and novel features of the present invention will become more apparent from the following detailed description when taken in conjunction with the accompanying drawings, in which:

DESCRIPTION OF THE PREFERRED EMBODIMENT

Figure 1:
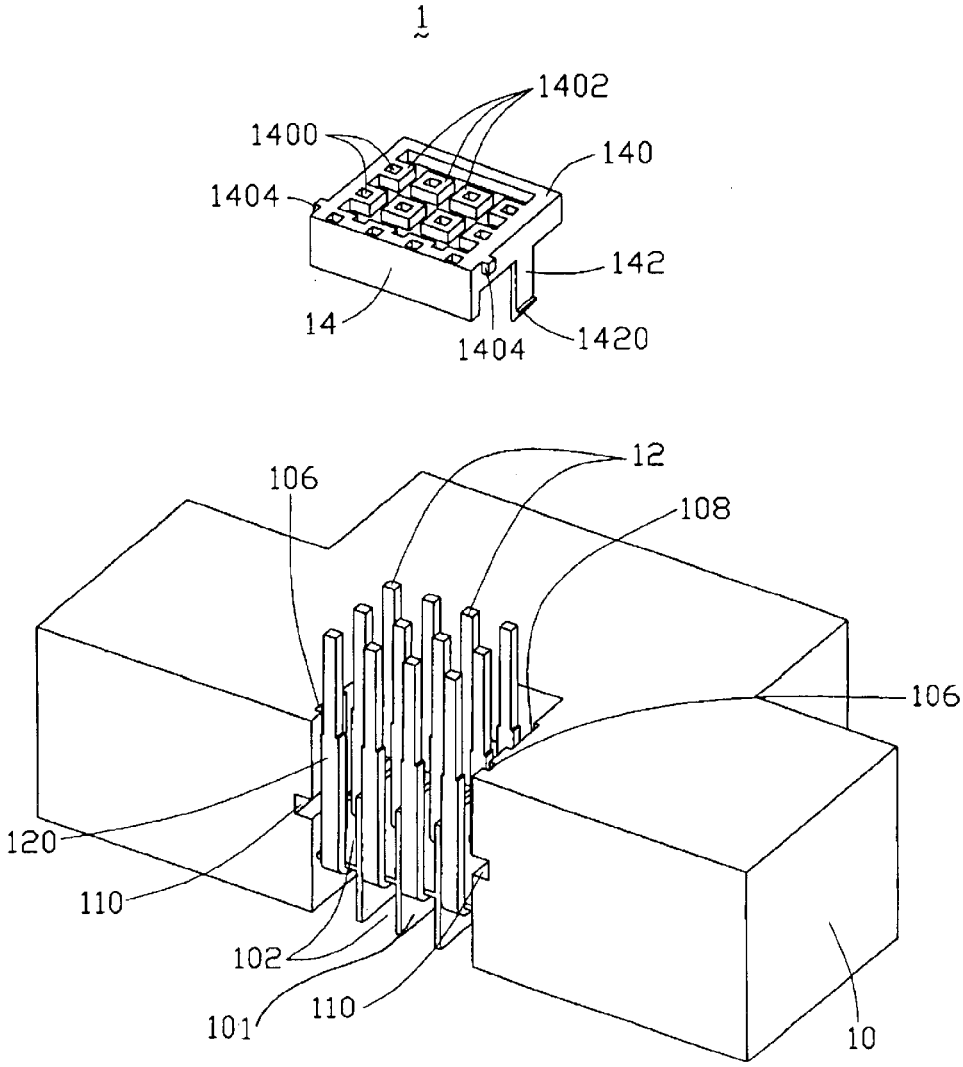
FIG. 1 is an exploded, isometric view of an electrical connector in accordance with the preferred embodiment of the present invention.

Reference will now be made to the drawing figures to describe the present invention in detail.

Figure 2:
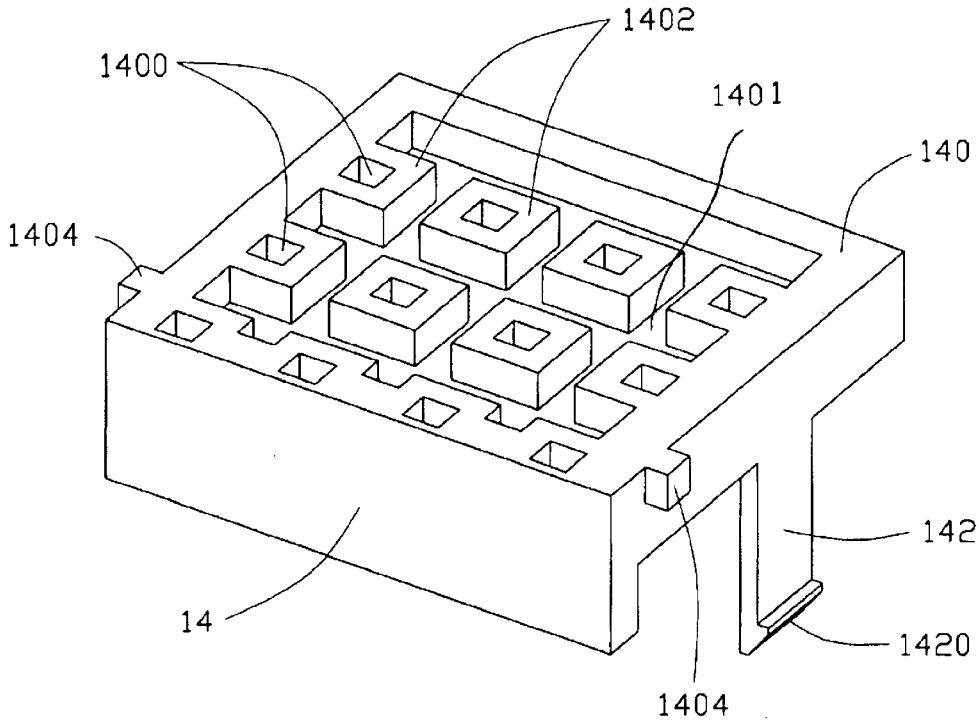
FIG. 2 is an isometric view of a spacer for the electrical connector.

Referring to FIGS. 1–2, an electrical connector 1 in accordance with the preferred embodiment of the present invention is used to supply power to a computer system (not shown). The electrical connector 1 comprises an insulative housing 10 defining a plurality of channels 102, a plurality of contacts 12 partially received in the housing 10, and a spacer 14 engaged with the housing 10. The housing 10 defines a pair of guiding slots 106, a pair of fastening slots 108, and a pair of hooking slots 110 perpendicularly communicating with the fastening slots 108. Each contact 12 partially received in the housing 10 protrudes out from the housing 10 via a corresponding channel 102, and comprises a distal tail portion 120 perpendicular to the channel 102. A plurality of dividers 101 are formed on a rear portion of the housing 10 to isolate the tail portion 120 of each individual contact 12.

Figure 3:
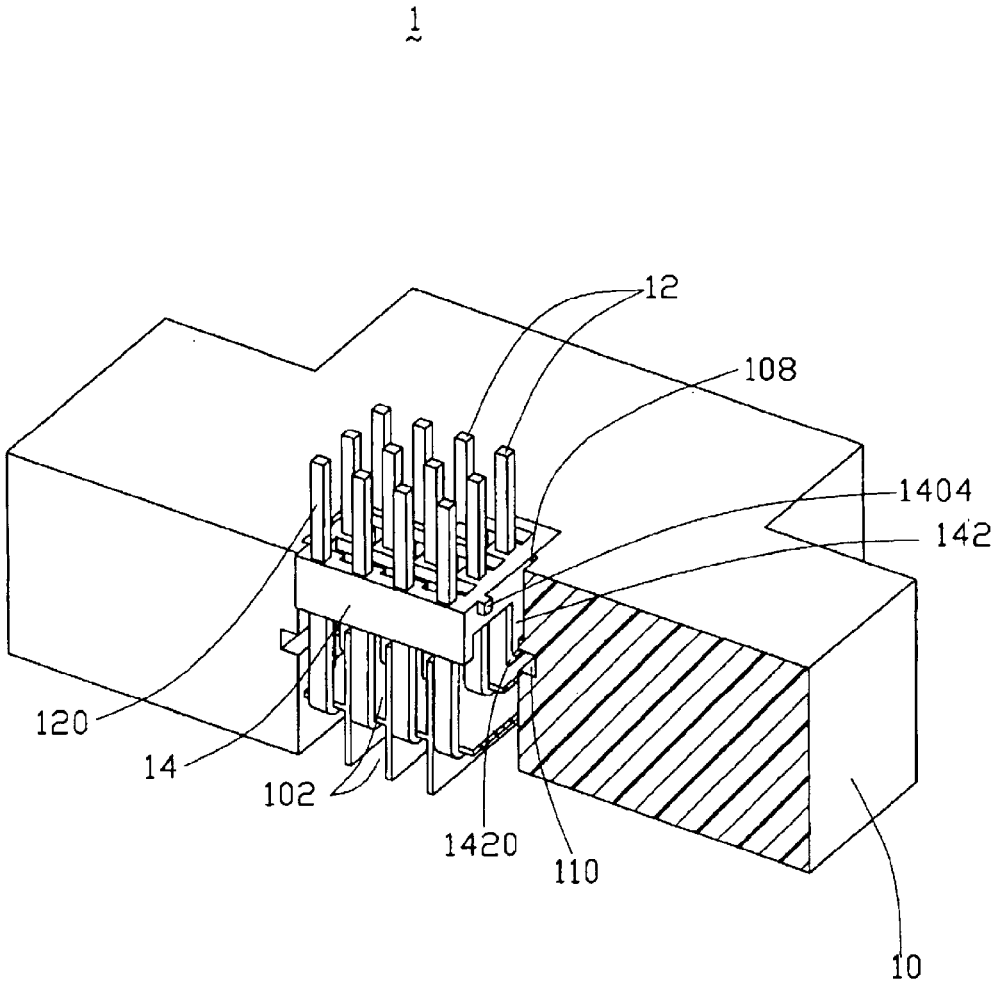
FIG. 3 is an isometric view of the electrical connector with a part cut off.
Figure 4:
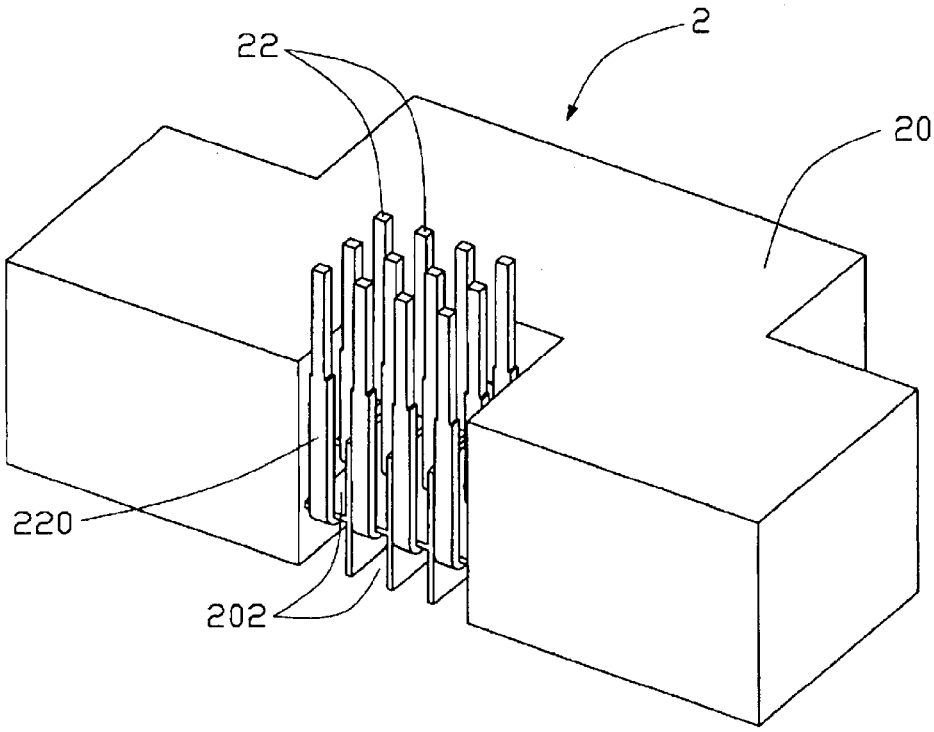
FIG. 4 (PRIOR ART)
FIG. 4 is an isometric view of a conventional electrical connector.

Referring to FIGS. 2–3, the spacer 14 comprises a base 140, a pair of fastening arms 142 depending from opposite sides of the base 140, and a pair of guiding blocks 1404 extending from the opposite sides of the base 140. The base 140 comprises a plurality of island platforms 1402 extending away from a common surface 1401. Each island platform 1402 defines a passageway 1400 spanning through the entire base 140. The island platforms 142 defines a plurality of intertwined troughs (not labeled) formed among those island platforms 142 and in alignment with the corresponding dividers vertically. Each fastening arm 142 comprises a hook 1420 at a distal end thereof.

When the spacer 14 is mounted on the housing 10, the tail portions 120 of the contacts 12 are received through the corresponding passageways 1400, with the spacer 14 being pushed downward. At the same time, the guiding blocks 1404 slide in the guiding slots 106 and the fastening arms 142 slide in the fastening slots 108 until the hooks 1420 of the fastening arms 108 hook in the hooking slots 110. The spacer 14 effectively shortens deformable lengths of the tail portions 120 and enhances strengths of the tail portions 120 during mounting of the tail portions 120 to a PCB. In particular, the tail portions 120 resist bending or breakage when the connector 3 is mounted on the PCB with improper external force.

While the present invention has been described with reference to a specific embodiment, the description is illustrative of the invention and is not to be construed as limiting the invention. Various modifications can be made to the preferred embodiments by those skilled in the art without departing from the true spirit and scope of the invention as defined by the appended claims.

What is claimed is:

1. An electrical connector mounted on a printed circuit board (PCB), the electrical connector comprising:

an insulative housing defining a plurality of channels;

a plurality of contacts partially received in the housing; and a spacer engaged with the housing, the spacer comprising a base and defining a plurality of passageways through the base;

wherein the base of the spacer defines two fastening arms depending from the opposite sides thereof, and each of the fastening arms comprises a hook at a distal end thereof;

wherein the housing defines two fastening slots corresponding to the fastening arms of the spacer, and the housing further defines two hooking slots communicating with the fastening slots for receiving the hooks of the fastening arms;

wherein each of the contacts extends from the housing via a corresponding channel and electrically connects to the PCB through a corresponding passageway of the spacer.

2. The electrical connector as described in claim 1, wherein the spacer defines a plurality of island platforms respectively defining the passageways therethrough.

3. The electrical connector as described in claim 1, wherein the base further comprises a pair of guiding blocks extending from the opposite sides thereof, and the housing further defines a pair of guiding slots corresponding to the guiding blocks of the spacer.

4. The electrical connector as described in claim 1, wherein the hooking slot is perpendicular to the fastening slot.

5. An electrical connector comprising:

an insulative housing defining a plurality of channels;

a plurality of contacts received in the corresponding channels, respectively, each of said contacts defining a tail portion in a rear portion of the housing;

a plurality of dividers formed in the rear portion of the housing to isolate the tail portion of each of said contacts;

a spacer attached to the housing and defining a plurality of island platforms extending from a common surface thereof, each of the island platforms forming a passageway therethrough, the tail portion of the contacts extending through the corresponding platforms, respectively;

wherein a plurality of intertwined troughs are formed among said island platforms.

6. The connector as described in claim 5, wherein some of said troughs are vertically aligned with the corresponding dividers, respectively.

7. The connector as described in claim 5, wherein the spacer defines two fasting arms depending from the opposite sides thereof, and each of the fasting arms comprises a hook at a distal end thereof.

8. The connector as described in claim 7, wherein the housing defines two fastening slots corresponding to the fastening arms of the spacer, and the housing further defines two hooking slots communicating with the fastening slots for receiving the hooks of the fastening arms.

* * * * *